US009050483B2

(12) United States Patent
Frey

(10) Patent No.: US 9,050,483 B2
(45) Date of Patent: Jun. 9, 2015

(54) APPARATUS FOR MUSCLE STIMULATION

(71) Applicant: Helmut Frey, Gaggenau (DE)

(72) Inventor: Helmut Frey, Gaggenau (DE)

( * ) Notice: Subject to any disclaimer, the term of this patent is extended or adjusted under 35 U.S.C. 154(b) by 48 days.

(21) Appl. No.: 13/624,954

(22) Filed: Sep. 23, 2012

(65) Prior Publication Data

US 2013/0079196 A1 Mar. 28, 2013

(30) Foreign Application Priority Data

Mar. 24, 2010 (DE) ..... 10 2010 012 676

(51) Int. Cl.

| | |
|---|---|
| ***A63B 22/04*** | (2006.01) |
| ***A61H 1/00*** | (2006.01) |
| ***A61H 1/02*** | (2006.01) |
| ***A61H 5/00*** | (2006.01) |
| ***A63B 24/00*** | (2006.01) |

(52) U.S. Cl.

CPC ..... *A63B 24/00* (2013.01); *A61H 1/003* (2013.01); *A61H 1/0237* (2013.01); *A61H 1/0274* (2013.01); *A61H 2201/0157* (2013.01); *A61H 2201/1215* (2013.01); *A61H 2201/1635* (2013.01); *A61H 2201/164* (2013.01); *A61H 2201/5061* (2013.01); *A61H 2201/5071* (2013.01)

(58) Field of Classification Search

CPC ..... A63B 24/00; A63B 21/072; A63B 22/00; A63B 2200/0017; A63B 2022/0053; A63B 22/0015; A63B 22/0048; A63B 22/0056; A63B 23/03533; A63B 23/03541; A61H 1/00; A61H 1/02; A61H 1/0237; A61H 1/024; A61H 1/0262; A61H 1/0266; A61H 2201/00; A61H 2201/0157; A61H 2201/12; A61H 2201/1215; A61H 2201/1223; A61H 2201/123; A61H 2201/1253; A61H 2201/1261; A61H 2201/14; A61H 2201/1436; A61H 2201/1481; A61H 2201/149; A61H 2201/164; A61H 2201/50; A61H 2201/5005; A61H 2201/5058; A61H 2201/5061; A61H 2201/5064; A61H 2201/5071; A61H 2203/0406; A61H 2205/00; A61H 2205/10; A61H 2205/12

USPC ..... 482/1, 4–7, 51–53; 601/5, 23, 27, 601/29–35, 84, 89, 90, 92, 93, 97, 98, 100, 601/101, 104

See application file for complete search history.

(56) References Cited

U.S. PATENT DOCUMENTS

| | | | | |
|---|---|---|---|---|
| 2,235,183 | A * | 3/1941 | Wettlaufer | 601/65 |
| 3,540,436 | A | 11/1970 | Haeftie | |
| 3,747,924 | A * | 7/1973 | Champoux | 482/52 |
| 4,185,622 | A | 1/1980 | Swenson | |

(Continued)

FOREIGN PATENT DOCUMENTS

| | | |
|---|---|---|
| JP | 2007283004 | 11/2007 |
| WO | WO 2009000487 A1 * | 12/2008 |

*Primary Examiner* — Oren Ginsberg
*Assistant Examiner* — Gary D Urbiel Goldner
(74) *Attorney, Agent, or Firm* — Klaus J. Bach

(57) ABSTRACT

In an apparatus for muscle stimulation with at least one motor and with two motor-operated drives, wherein each of these drives and a stepping plates are mounted in a frame and each of these drives is a revolving linkage square and the driven drive member is in each case a crank mounted in the frame, a crank and a stepping plate are in each case connected in an articulated manner by means of a coupling member providing for an apparatus for muscle stimulation with stepping plates that can be operated both with low and also with high stroke frequencies.

6 Claims, 6 Drawing Sheets

(56) References Cited

U.S. PATENT DOCUMENTS

| | | | | | |
|---|---|---|---|---|---|
| 4,676,501 | A * | 6/1987 | Hoagland et al. | 482/51 |
| 4,989,857 | A * | 2/1991 | Kuo | 482/52 |
| 5,013,031 | A * | 5/1991 | Bull | 482/52 |
| 5,443,439 | A * | 8/1995 | Ohshita | 601/90 |
| 5,468,215 | A * | 11/1995 | Park | 601/23 |
| 5,500,002 | A * | 3/1996 | Riddle et al. | 606/242 |
| 6,004,244 | A * | 12/1999 | Simonson | 482/52 |
| 6,217,491 | B1 * | 4/2001 | Schiessl | 482/92 |
| 6,659,918 | B2 * | 12/2003 | Schiessl | 482/92 |
| 7,108,637 | B2 * | 9/2006 | Maresh | 482/52 |
| 7,367,957 | B2 * | 5/2008 | Huang et al. | 601/31 |
| 7,887,464 | B1 * | 2/2011 | Jones et al. | 482/51 |
| 8,092,347 | B2 * | 1/2012 | Lanny | 482/51 |
| 2002/0183663 | A1 | 12/2002 | Lu et al. | |
| 2004/0214693 | A1 * | 10/2004 | Piaget et al. | 482/52 |
| 2006/0155221 | A1 * | 7/2006 | Kim | 601/29 |

* cited by examiner

APPARATUS FOR MUSCLE STIMULATION

This is a continuation-in-part application of pending international patent application PCT/DE2011/000310 filed Mar. 23, 2011 and claiming the priority of German patent application 10 2910 012 676.4 filed Mar. 21, 2010.

BACKGROUND OF THE INVENTION

The invention relates to an apparatus for muscle stimulation including a motor with two motor-operated drives wherein each of these drives comprises a frame and a stepping plate supported in the frame.

U.S. Pat. No. 3,540,436 A1 discloses such an apparatus. The individual drive is a three-member cam drive with a fully wrap-around cam surface. The manufacture of such a cam however requires special machinery and therefore is expensive to manufacture. In order to prevent a lift-off of the stepping plate, the stepping plate is pulled by a tension spring onto the rotating cam disc. Still, a high lift frequency may lead to lift-off of the stepping plate resulting in chatter noises.

It is therefore the object of the present invention to provide an apparatus for muscle stimulation, which can be operated at low as well as high frequencies.

SUMMARY OF THE INVENTION

This object is achieved with an apparatus having motor operated drives, wherein each drive comprises a quadrilateral linkage with a driven drive member being a crank supported in the frame. Furthermore, in each case, one crank and a stepping plate are pivotally interconnected by a coupling member.

The invention will become more readily apparent from the following description with reference to the schematic drawings:

DESCRIPTION OF A PARTICULAR EMBODIMENT

Figure 1:
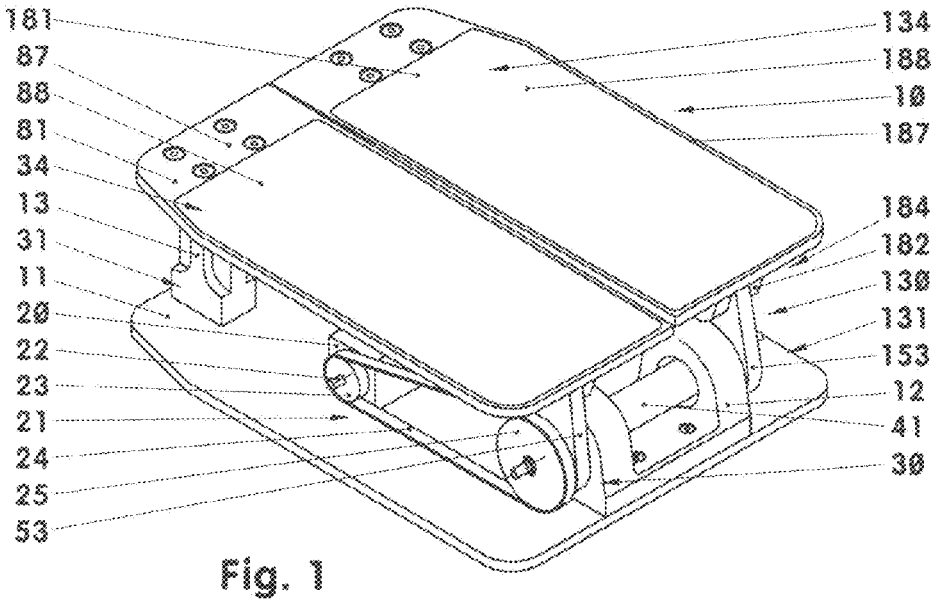
FIG. 1 shows an apparatus for muscle stimulation.

FIG. 1 shows a perspective view of an apparatus 10 for muscle stimulation. The apparatus 10 comprises a bottom plate 11 on which a motor 20 is disposed and two stepping plates 81, 181 which are each driven by the motor 20 and a drive 30, 130. The operating elements of the apparatus 10 and the enclosure are not shown.

The motor 20 which is for example screwed to the bottom plate 11 is in the shown embodiment a frequency-controlled three-phase motor. By varying the control frequency of the magnetic field of the motor 20, the speed of the motor 20 can be increased or decreased synchronously with the frequency. The apparatus 10 may also have two motors 20. Then each of the two motors 20 drives one stepping plate 81, 181 by way of a drive 30, 130. The two servomotors 20 may be synchronized with each other.

The individual motor may be a gear drive motor which drives for example directly an integral step-down gearing. The output speed of the gear drive motor, is then for example smaller than the described synchronous motor speed. The step-down gearing is a gear drive with parallel, cross-over or intersecting axes.

Also, the use of one or two DC motors with adjustable speed is possible.

In the arrangement as shown in FIG. 1, the motor 20 is connected to the drives 30, 130 by a pull member drive 21. The pull member drive 21 is in the exemplary embodiment a belt drive, which comprises a belt pulley 23 disposed on the motor shaft 22, a belt 24 and a belt pulley 25 disposed on the input shaft 41 of coupling drive 30, 130. The belt drive 21 may include a V-belt or a flat belt etc. The pull member drive 21 may also be a chain drive.

In the exemplary embodiment, the two belt pulleys 23, 25 are V-belt rib pulleys 23, 25, wherein the driven pulley 25 has for example 2.2 times the diameter of the drive pulley 23 of the motor. The ribbed V-belt 24 may for example have a steel inlay.

For adjusting the belt tension, the motor 20 may be movable for example in the longitudinal direction of the apparatus 10. The pull means 24 may also be tensioned by means of a self-tensioning arrangement, see FIGS. 2 and 3. It comprises for example a tensioning roller 26 and a spring 27.

Figure 2:
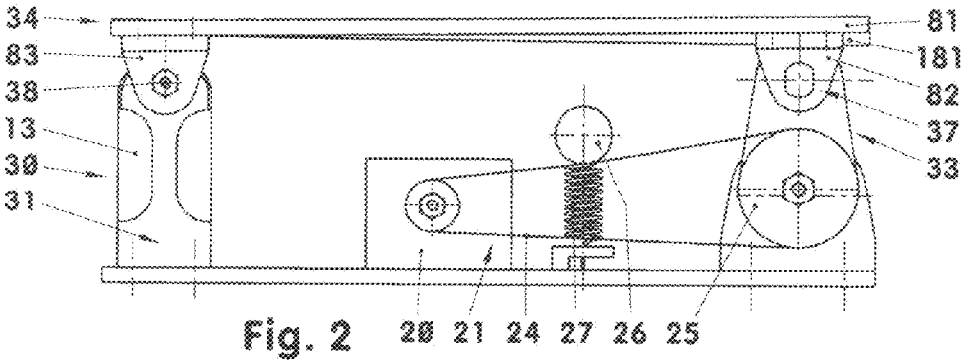
FIG. 2 is a side view of the apparatus.
Figure 3:
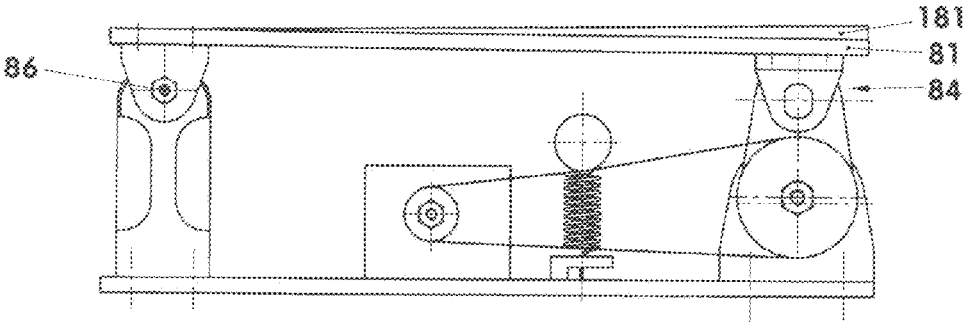
FIG. 3 is a side view after rotation of the crank by half a revolution.

In FIGS. 2 and 3, the apparatus 10 is shown in each case in a side view, however with different drive positions. In FIG. 2, the front stepping plate 81 facing the viewer is shown in its upper end position whereas the rear stepping plate 181 is shown in its lower end position. In FIG. 3, the drive 30, 130 is advanced to such an extent that the front stepping plate 81 is in its lower end position whereas the rear stepping plate 181 is in its upper end position.

The individual drive 30, 130—see FIGS. 1-5, is a revolvable quadrilateral linkage square with a frame 31, 131, a crank 32, 132, a connecting member 33, 133 and a further drive element formed by the stepping plate 81, 181 and its support flanges 82, 83, 182, 183. The individual frame 31, 131 is formed in the exemplary embodiment by the bottom plate 11, a front bearing support 12 and a rear bearing support 13. The support flanges 82, 83, 182, 183 and the bearing supports 12, 13 may comprise several parts. In the frame 31, 131, the crank 32, 132, on one hand, the crank 32, 132 is rotatably supported in the crank joint 35, 135 and, on the other hand, the stepping plate element 81, 181 is rotatably supported in the frame joint 38, 138. In accordance with FIGS. 1-5, the pivot axis and the axes of rotation of all of the joints 35-38; 135-138 extend normal to a vertical longitudinal center plane of the apparatus 10.

The crank 32, 132 is formed by the drive shaft 41 with an eccentrically arranged bearing mount 42, 142. The input drive shaft 41 which, in accordance with the sectional representation of FIG. 4, interconnects the two drives 30, 130 carries at one end thereof the belt pulley 25. It is rotatably supported in the front bearing support 12 for example by means of two grooved ball bearing 43, 44. The inner rings 45 of the bearings 43, 44 abut a shaft shoulder 45 and are axially fixed on the shaft 41 by means of a locking ring 47. In the exemplary embodiment the outer rings 48 abut the bearing support 12.

The eccentrically arranged bearing mounts 42, 142 are disposed in the exemplary embodiment outside the bearings 43, 44. They may for example be displaced relative to each other in a direction normal to the virtual center line 49 at the drive shaft 41. In the exemplary embodiment, the extremities of the two eccentrically arranged bearing mounts 42, 142 with respect to a rotational phase angle of the drive shaft 41 are displaced by 180°. The length of the 32, 132 is the distance between the centerline 49 of the drive shaft 41 and the centerline of the eccentrically arranged bearing mount 42, 142 of the respective coupling drive 30, 130. In the exemplary embodiment shown in FIGS. 1-5, the sum of the diameter of an eccentrically arranged bearing mount 42, 142 and twice the eccentricity is smaller than the diameter of the bearing support 51 of the input drive shaft (41).

Figure 4:
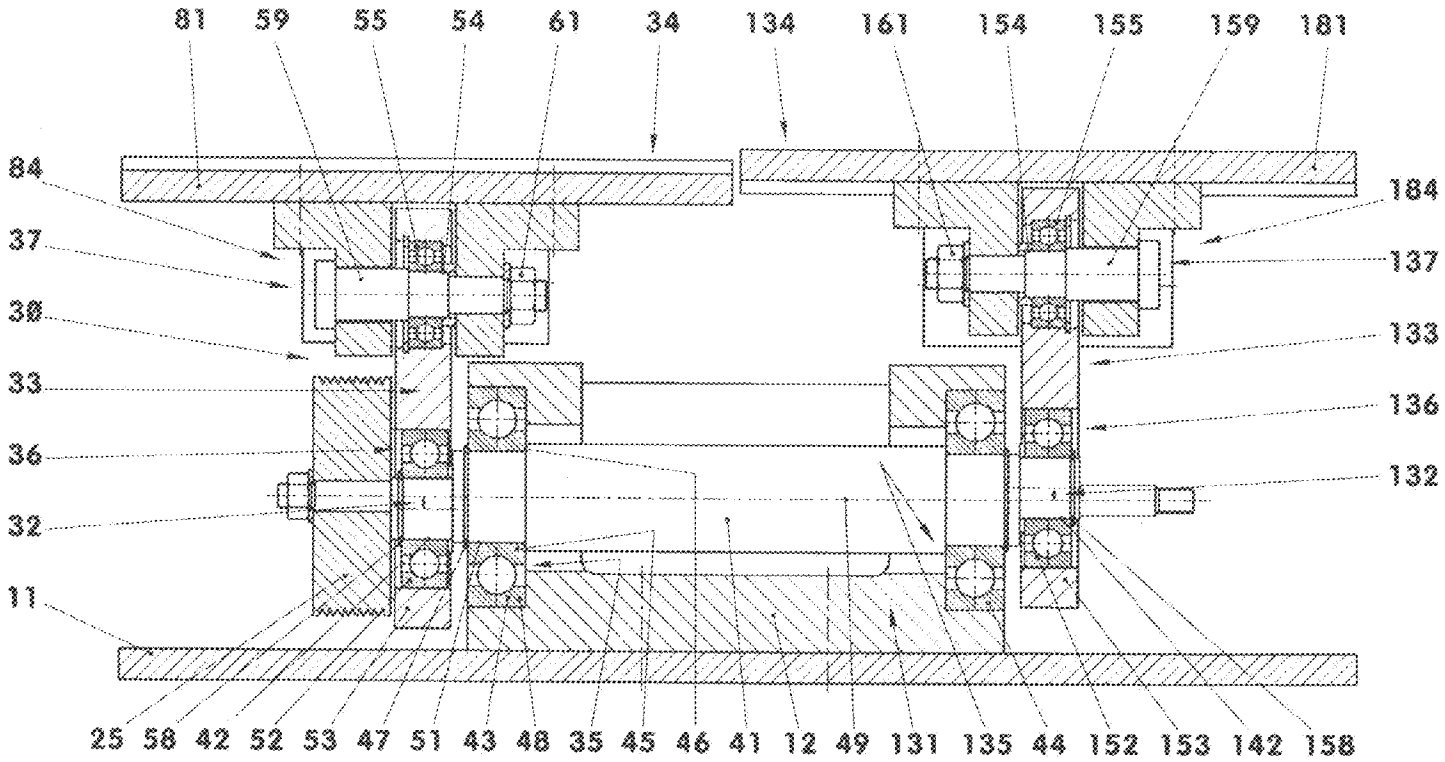
FIG. 4 is a cross-sectional view of the drive.

The eccentrically arranged bearing mounts 42, 142 support in the representation of FIG. 4 each a non-friction bearing 52, 152, which again carries each a support plate 53, 153. The support plate 53, 153 forms the connecting member 33, 133, which is supported rotatably on the crank 32, 132 by means of the connecting joint 36, 136. A second support mount 54, 154 of the support plate 53, 153 supports, by means of another non-friction bearing 55, a pivot bolt 59, 159 of the front stepping plate support structure 84, 184. The distance between the pivot axes of the bearings 52, 55, 152, 155, which extend parallel to each other is the length of the connecting member 33, 133. The non-friction bearings 43, 44, 52, 55, 152, 155 are in the exemplary embodiment grooved ball bearings which are sealed at both sides. But roller bearings, inclined ball bearings, needle bearings etc., may also be used.

Each stepping plate 81, 181 is supported on one hand via the connecting member 33, 133 by means of a front stepping plate joint 37, 137 an on the frame 31, 131 by means of a frame pivot joint 38, 138. The frame support joints 38, 138 comprise each a pivot bolt 86, 186 supported in the rear by the rear bearing support (13), for example multipart support flange 83, 183 by means of friction bearing sleeves 85, 185 which consist of POM.

The two stepping plates 81, 181 are arranged axially symmetrically with respect to a vertical longitudinal center plate of the apparatus 10. For example, the constant distance of the two stepping plates 81, 181 from each other is less than 2 millimeters. The individual stepping plate 81, 181 is an at least approximately rectangular plate which consists for example of an aluminum alloy. In the exemplary embodiment, its length is 490 mm, its width is 200 mm and its thickness is 10 mm. Its top side 87, 187 has a recessed surface area onto which a slip-resistant rubber mat 88, 188 is cemented. At the top side 87, 187 of the stepping plates 81, 181 in each case one or several rope ears or hooks may be arranged into which a grommet of a rope provided with a handle may be hooked.

During assembly, for example, first the bearing supports 12, 13 and the motor 20 are mounted onto the bottom plate 11. The drive shaft 41 is then placed into the front bearing support 12 and a grooved ball bearing 43, 44 is slipped onto the bearing supports 51 from the two shaft ends and in each case secured by means of a locking ring 47. After the mounting of the support plates 53, 153, the grooved ball bearings 52, 152 are slipped onto the eccentrically arranged bearing mounts 42, 142 and secured for example by means of locking rings 58, 158. After sliding in the bearings 55, 155, the stepping plates 81, 181 are put in place. In each case, a flange bolt 59, 159 is inserted and secured for example by a hexagonal unit 61, 161. In the frame 31, 131, the individual stepping plate 81, 181 is secured by means of the bolt 86, 186.

After installation and securing of the belt pulleys 23, 25 and the belt 24, the belt 24 is tensioned for example by a displacement of the motor 20.

During operation of the apparatus 10, the user stands with each foot on one of the stepping plates 81, 181. The motor 20 drives by means of the pull member drive 21 the two coupling drives 30, 130. In this way, with each rotation of the input drive shaft 41, each crank is turned by one turn. The two connecting members 33, 133 are positively actuated by the cranks 32, 132 so that the stepping plate joints 37, 137 are moved up and down from, for example, a neutral start out position. During one rotation of a crank, the respective support plate joint 37, 137 reaches a maximum and a minimum. The overall stroke of the stepping plate joint 37, 137 is for example 7 millimeter. The stroke frequency of the stepping plate 81, 181 is between 3 Hz and 30 Hz.

During the oscillating stroke movement each of the two stepping plates pivots about the frame pivot joint 38, 138. The pivot angle out of the neutral position is for example +/− one angular degree.

The stroke frequency of the stepping plates 81, 181 changes proportionally with the drive speed of the motor 20. In this way, the stimulation of the muscles of the user is influenced.

Figure 13:
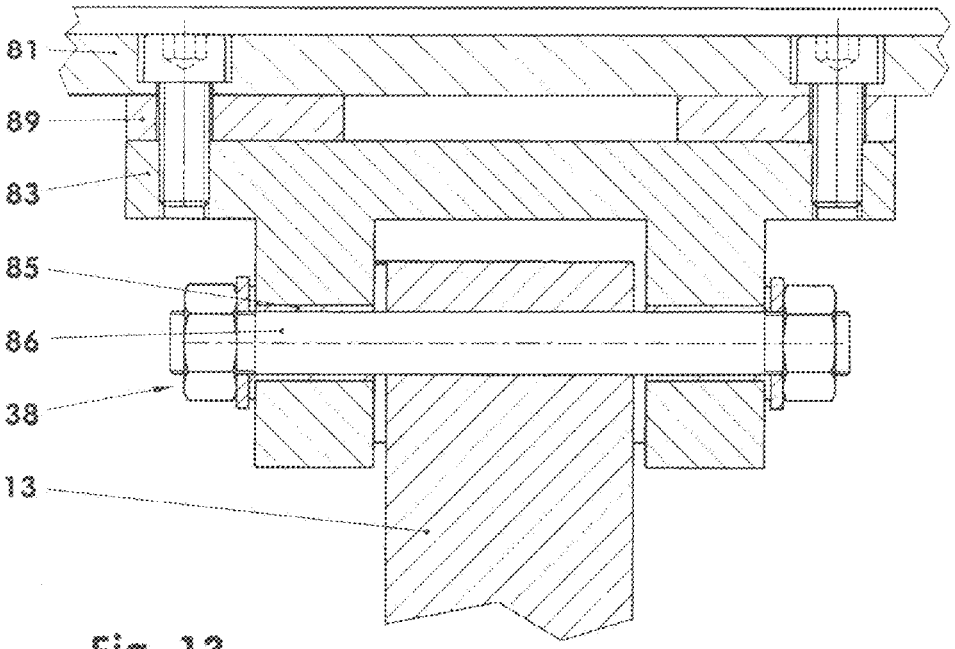
FIG. 13 shows a support including sensors.

FIG. 13 shows a stepping plate 81 with a support flange 83 wherein a pressure sensor 89 is arranged between the two components 81, 83. If for example at high frequency, the foot of the user is partially lifted off the stepping plate 81, the load on the stepping plate is reduced and is suddenly reapplied when the foot load is reinstated. The electrical output signal of the sensor, which for example is in the form of a pressure sensor cell or an expansion measurement strip, is changed. This signal change causes the control arrangement of the motor 20 for example to reduce the motor speed. Only when the feet of the user are again fully disposed on the stepping plates the original signal level of the sensor 89 which reacts to deformations is again re-established.

Such sensors 89 may be arranged in, or on, the frame-side stepping plate support joint 38 as well as at the coupling-side stepping plate support joint 37. The summing signal of the two sensors 89 then is to a large extent independent of the position of the user on the stepping plate 81, 181.

For the evaluation, a control signal depending on the mass or, respectively, the mass moment of inertia of the user may be determined but only after an initial operation of for example 10 seconds.

Figure 6:
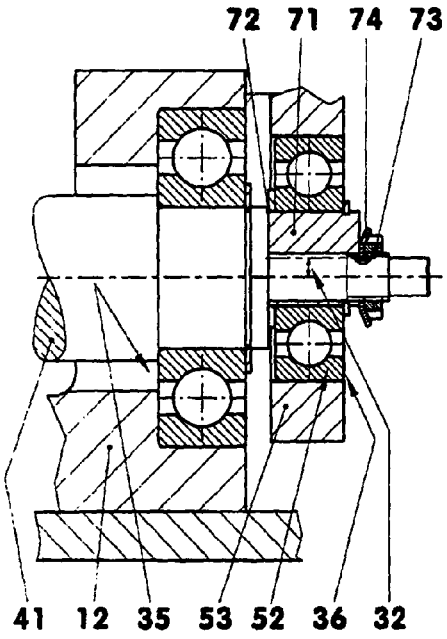
FIG. 6 shows an adjustable eccentric.

FIG. 6 shows a partial sectional view of an apparatus 10 in the area of a drive shaft 41 which comprises coaxial cylindrical sections. On the drive shaft 41, eccentric ring 71 is disposed, which carries the stepping plate bearing 52 and which abuts a shaft shoulder 72 and is secured by means of a shaft nut 73 and a locking plate 74. The eccentric ring 71 may be provided at the nut- and/or shoulder side with a planar teeth structure which is engaged by a counter-tooth structure provided on the shaft shoulder 72 or a locking ring 74 of the shaft unit 73. The eccentric ring 71 may be positioned on the drive shaft 41 for example by means of a fitting spring. The eccentric ring 71 may be exchangeable for example by another eccentric ring with different eccentricity.

In order to adjust the eccentricity and consequently the length of the crank 32, the shaft unit 23 is loosened. The eccentric ring 71 can then be steplessly rotated for example on the basis of a scale. When the new crank length is adjusted, the crank unit 73 is again tightened. With a form-locking structure disposed for example between the eccentric ring 71 and the shaft should 72, a step-wise adjustment of the crank length is possible. With an adjustability of the eccentricity of the connecting joint 36, the stroke of the stepping plate 81 is adjustable. In the exemplary embodiment, a stroke adjustment of between two and seven millimeter is possible.

The two drives 30, 130 may have different crank length. To this end, the eccentric rings 71 may be adjusted differently. As a result, the stroke travel of the two stepping plates 81, 181 may be different.

The two drives 30, 130 may also be so adjusted that the phase displacement of the two maxima and/or minima differs from 180 degrees. To this end, the two stepping plates 81, 181 are so adjusted that the maximum of the one stepping plate does not coincide, time wise, with the minimum of the other stepping plate 81, 181. In this case, the drive shaft 41 may be provided with an eccentric weight for mass compensation.

Figure 7:
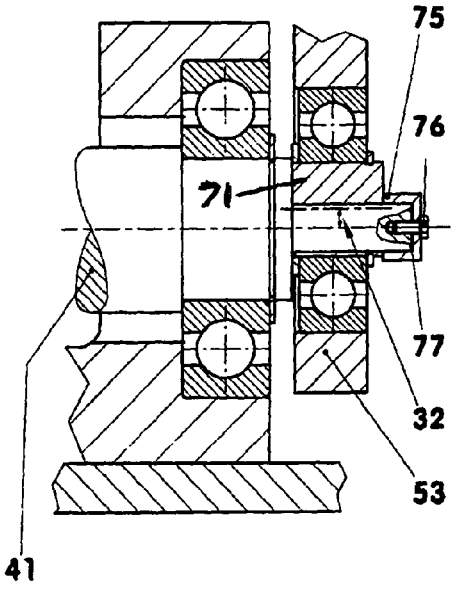
FIG. 7 shows an eccentric with front cover.

FIG. 7 shows a drive shaft 41 with an eccentric ring 71 which is fixed by means of a front cup 75. The front cup 75 is mounted cup 75 is mounted to the front end 77 of the drive shaft 41 for example by means of a screw 76. A connection by means of two screws, a form-locking element, for example a locking pin and a screw 76 etc. . . . is also possible. Also, in this case a scale may be provided on the front cup 75 on the basis of which the eccentric ring 71 may be adjusted by means of counter marks.

The eccentric ring 71 may also be fixed by means of a rapid clamping arrangement. Herein the eccentric ring 71 may be operated from outside of the apparatus 10 by loosening or clamping of an operating handle. Also, the eccentric adjustment may be performed for example from the outside by means of a tool.

Figure 8:
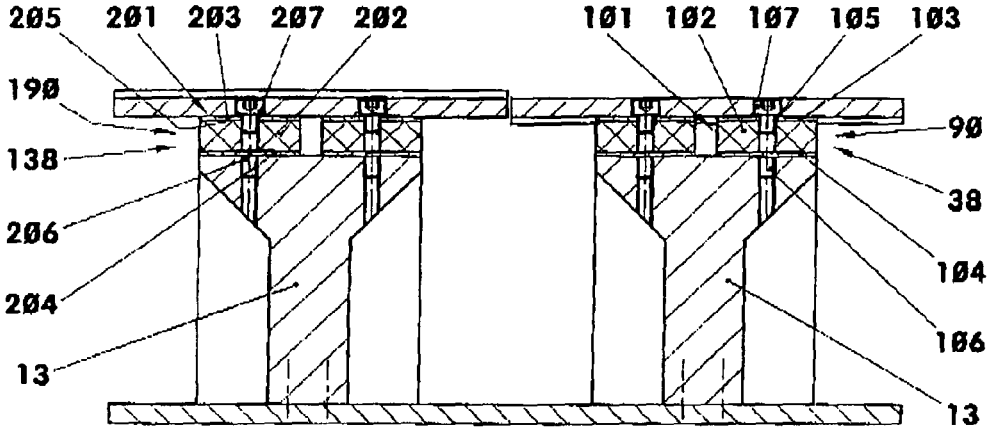
FIG. 8 shows the support for the stepping plate by an elastomer body.

FIG. 8 shows the support of two stepping plates 81, 181 by way of elastically deformable elements 90, 190. They are two composite bodies 101, 201 formed each by an elastomer body 102, 202 with metal plates 103, 104, 203, 204 vulcanized onto the front sides thereof. The upper metal plate 103, 203 has for example a threaded bore 105, 205. The lower metal plate 104, 204 carries a threaded pin 106, 206 which projects from the elastomer body 106, 206 and which is threaded into the respective bearing support 13. Into the threaded bore 105, 205 in each case a mounting screw 107, 207 for mounting the stepping plate 81, 181 is threaded. The elastomer body 102, 202 has for example a hardness of between 40 and 60 shore. The composite body 101, 201 prevents in this way abrupt strike exposures of the user which could occur at reversal points of the stepping plate movements.

Figure 5:
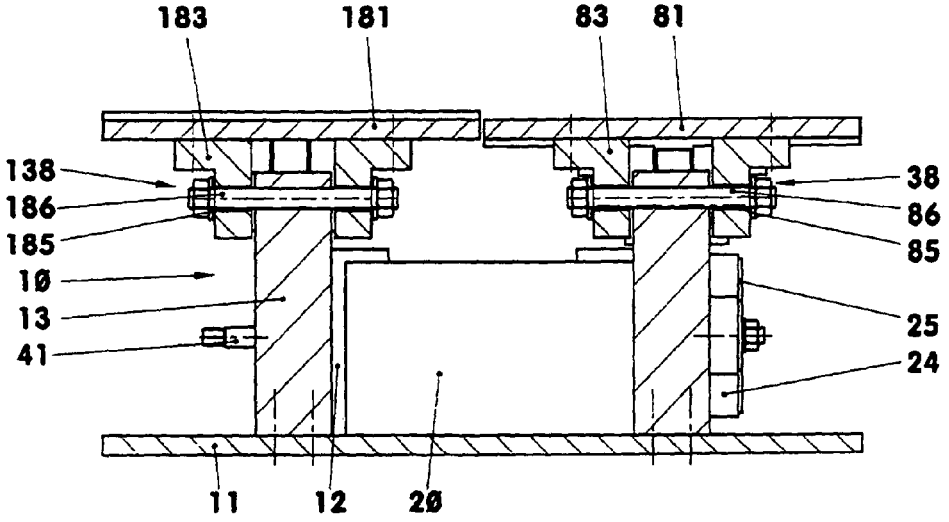
FIG. 5 is a cross-sectional view of the stepping plate support in the frame.

During operation of the apparatus 10 with such a frame- and/or coupling-side stepping plate support arrangement 37, the elastomer body 102, 202 also permits an inclined position of the two metal plates 103, 104, 203, 204 relative to each other up to an angle of, for example, three degrees. The composite body 101, 201 could therefore replace the friction or non-friction bearing support of the stepping plates 81, 181 as shown in FIG. 5. But it may also be provided in addition to the bearings.

Figure 9:
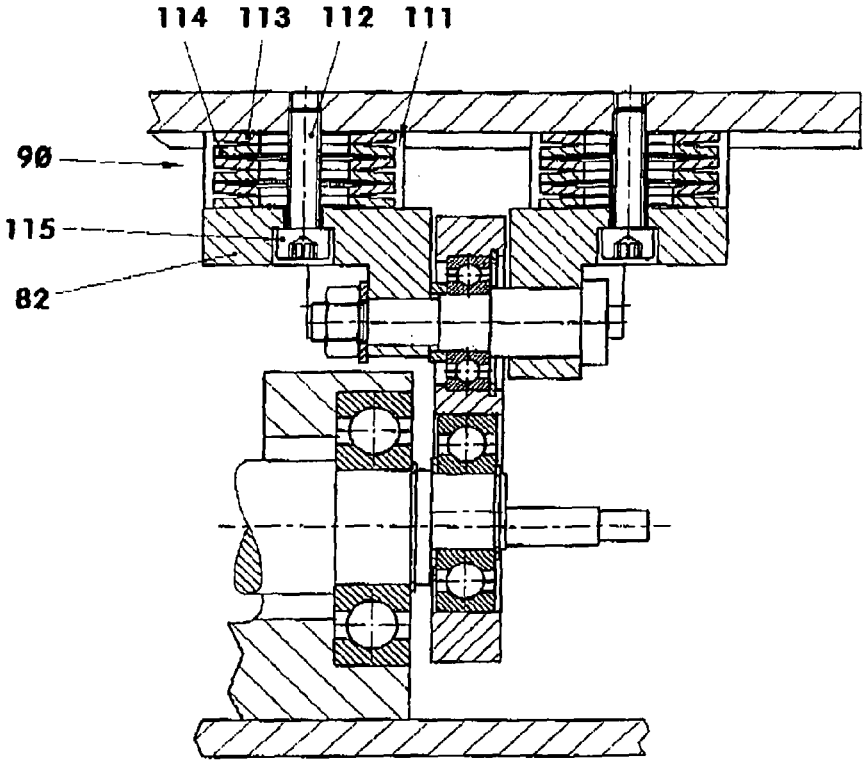
FIG. 9 shows the support for the stepping plate by plate springs.

FIG. 9 shows a double-sided stepping plate support arrangement 37 which comprises as elastically deformable elements 90, 190 two plate spring packets 111. Here, for example, in each case, a screw 112 is threaded from the bottom through the support flange 82 and the plate spring packet 111 into the stepping plate 81. The pretension of the plate spring packet 111 is adjustable by means of the screws 112. In this way, the stepping plate support 37 can be adjusted to be harder or softer.

As shown in FIG. 9, in each case one plate spring 113 of a plate spring packet 111 is oriented upwardly whereas the adjacent plate spring 114 is oriented downwardly. But it is also possible to combine and orient two adjacent plate springs 113 upwardly and the next two adjacent ones 114 downwardly.

In the arrangement of FIG. 9, the coupling-side stepping plate joint or support 37 may be provided, instead of by a non-friction bearing 55, by a leaf spring. The leaf spring is then attached to the support plate 53 and the support flange 82. The bending line then extends for example parallel to the bottom plate 11.

Figure 10:
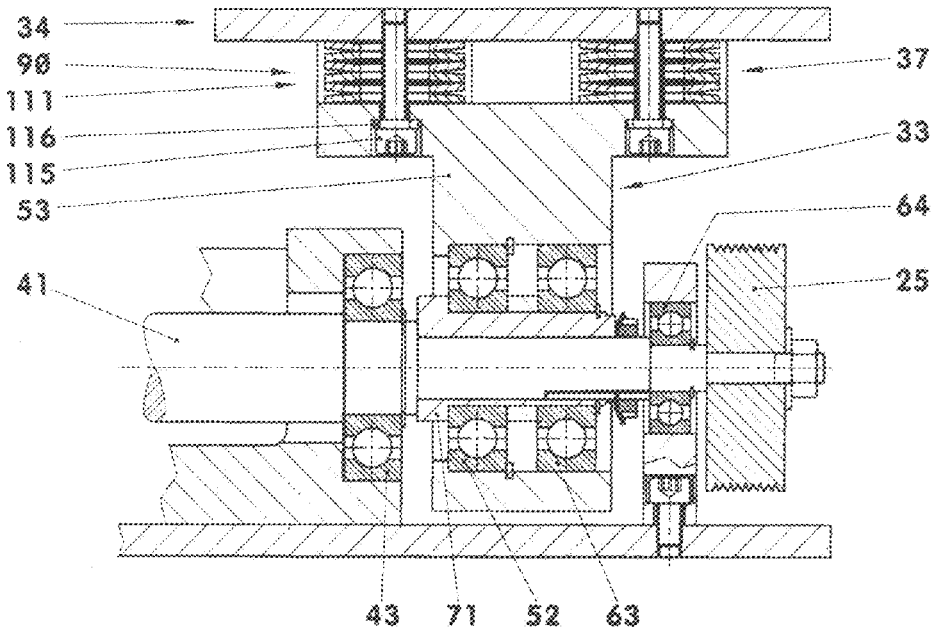
FIG. 10 shows the stepping plate support without non-friction or friction bearings.

The screw head 115 may for example be disposed on an arched washer 116 provided with an elongated opening, see FIG. 10. The washer may have a surface with a small friction coefficient. In the embodiment of the stepping plate support 37, 38 without friction and/or antifriction bearing the described support structure may also take on the joint function.

Also, the use of a composite body with an elastomer body and front metal plates with a throughbore instead of the plate spring packets 111 is possible.

Figure 12:
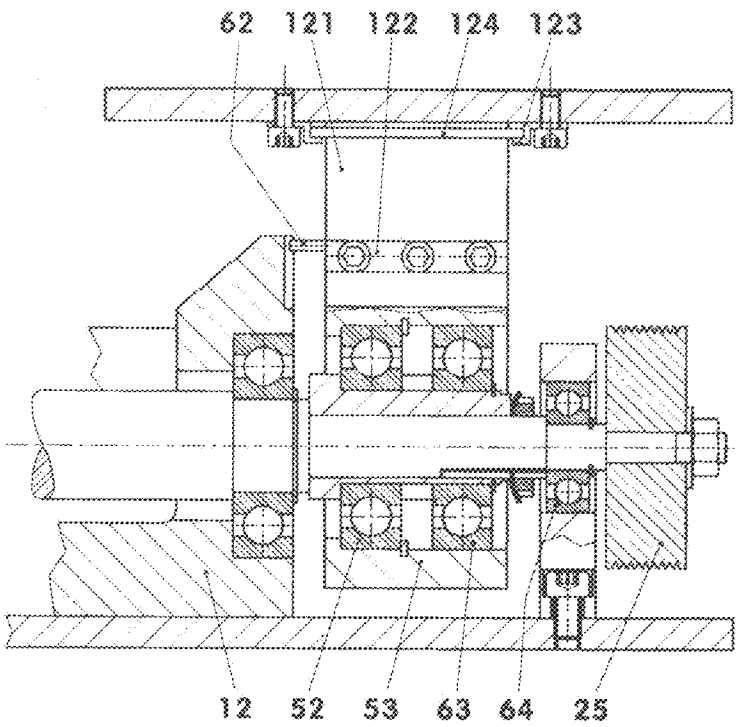
FIG. 12 is a partially sectional view of FIG. 11.
Figure 11:
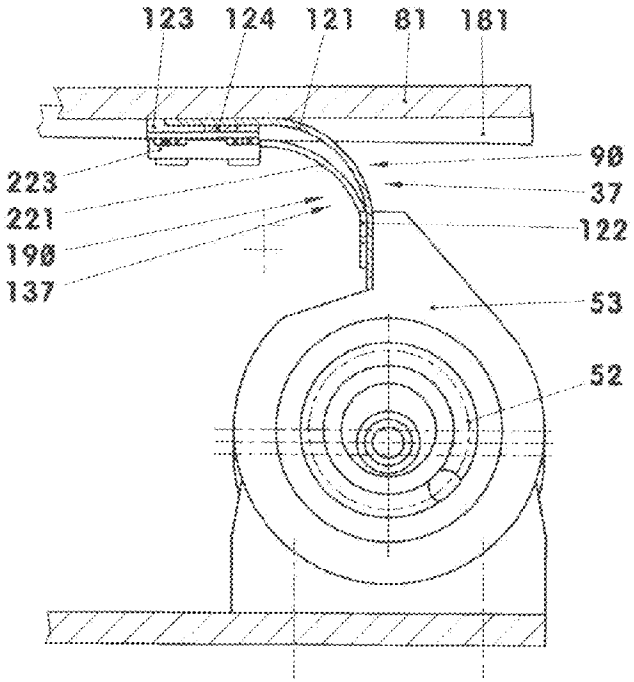
FIG. 11 shows the support of the stepping plate by leaf springs.

FIGS. 11 and 12 show an apparatus 10 whose coupling-side stepping plate joints 37 comprise leaf springs 121. In FIG. 11, the belt pulley 25 and the support bearing 64 are removed. FIG. 12 shows a partial sectional view of FIG. 1 in the area of the support plate 53. The individual elastically deformable element 90, 190, that is, the individual bent leaf spring 121, 221, is mounted to the support plate 53 so as to extend for example at least approximately vertically. In addition, it is locked by means of a locking sheet 122. In the exemplary embodiment, the support plate 53 is vertically guided by means of a guide bolt 62 in the front support 12.

At the stepping plate side, the leaf springs 121, 221 are supported at the bottom side of the stepping plates 81, 181, for example, in each case in two guide tracks 123, 223. An adjustment sheet 124 which is adjustable in the longitudinal direction of the stepping plate 81, 181 is pressed onto the leaf spring 121 by means of the guide elements 123 so that the leaf spring position relative to the stepping plate 81, 181 is maintained. By an axial adjustment of the adjustment sheet 124, the spring length of the leaf spring and as a result the spring stiffness can be adjusted. The shorter the spring length, the higher is the stiffness of the support.

Also a multi-layer leaf spring pack may be used. In order to increase the stiffness of the support, two or several leaf springs 121 may also be arranged in parallel relationship.

Such a coupling-side stepping plate arrangement 37 may be combined for example with a frame-side stepping plate support 38 including a composite body 101.

FIG. 12 discloses three identical non-friction bearings 43, 53, 63 for supporting a stepping plate 81, 181. The support bearing 64 in the form of a loose bearing has in the exemplary embodiment has with regard to these bearings a smaller inner and outer diameter. However, it also possible to use identical bearing elements for all non-friction bearing locations.

Also, in such an apparatus 10, the crank length and/or the phase angle difference may be adjustable.

The pull member drive 21 may be arranged between the two drives 30, 130. It is also possible to provide a pull member drive 21 for each drive 30, 130. It is also possible not to use any pull member drive 21 for the apparatus 10.

Also combinations of the various exemplary embodiments are possible.

Listing of Reference Numerals

| | |
|---|---|
| 10 | Apparatus for muscle stimulation |
| 11 | Bottom plate |
| 12 | Bearing support |
| 13 | Bearing support, front |
| 20 | Motor |
| 21 | Pull member drive, belt drive |
| 22 | Motor shaft |
| 23 | Belt pulley, input side; gear disc pulley |
| 24 | Pull means, belt, gear belt |
| 25 | Belt pulley, output side, gear disc pulley |
| 26 | Tensioning roller |
| 27 | Spring |
| 30 | Drive, coupling drive |
| 31 | Frame |
| 32 | Crank |
| 33 | Connector, connecting member |
| 35 | Crank joint, rotational support |
| 36 | Connecting joint, rotational support |
| 37 | Stepping plate joint, front stepping plate joint, pivot bearing, coupling-side stepping plate support |
| 38 | Frame joint, pivot joint |
| 41 | Drive shaft |
| 42 | Bearing mount, eccentrically arranged |
| 43 | Non-friction bearing, grooved ball bearing |
| 44 | Non-friction bearing, grooved ball bearing |
| 45 | Inner ring |
| 46 | Shaft shoulder |
| 47 | Locking ring |
| 48 | Outer ring |
| 49 | Centerline of (41) |
| 51 | Bearing support of (41) |
| 52 | Non-friction bearing, grooved ball bearing |
| 53 | Support plate |
| 54 | Support seat |
| 55 | Antifriction bearing, grooved ball bearing |
| 58 | Locking ring |
| 59 | Flange bolt |
| 61 | Hexagonal nut |
| 62 | Guide bolt |
| 63 | Non-friction bearing |
| 64 | Support bearing |
| 71 | Eccentric ring |
| 72 | Shaft shoulder |
| 73 | Shaft nut |
| 74 | Locking plate, locking ring |
| 75 | Front cup |
| 76 | Screw |
| 77 | Front end of shaft 41 |
| 81 | Stepping plate, drive element |
| 82 | Support flange, front |
| 83 | Support flange, rear |
| 84 | Stepping plate support, front |
| 85 | Friction bearing sleeve |
| 86 | Pivot bolt |
| 87 | Top side |
| 88 | Rubber mat |
| 89 | Pressure sensitive sensor |
| 90 | Elastically deformable element |
| 101 | Composite body |
| 102 | Elastomer body |
| 103 | Metal plate |
| 104 | Metal plate |
| 105 | Threaded bore |
| 106 | Threaded pin |
| 107 | Mounting screw |
| 111 | Plate spring packet |
| 112 | Screw |
| 113 | Plate spring |
| 114 | Plate spring |
| 115 | Screw head |
| 116 | Washer |
| 121 | Leaf springs |
| 122 | Retaining sheet |
| 123 | Guide track |
| 124 | Adjustment sheet |
| 130 | Drive |
| 131 | Frame |
| 132 | Crank |
| 133 | Connector, connecting member |

-continued

Listing of Reference Numerals

| | |
|---|---|
| 135 | Crank joint |
| 136 | Coupling joint |
| 137 | Stepping plate joint |
| 138 | Frame joint |
| 142 | Bearing mount, eccentrically arranged |
| 152 | Non-friction bearing. Grooved ball bearing |
| 153 | Support plate |
| 154 | Support mount |
| 155 | Anti-friction bearing, grooved ball bearing |
| 158 | Locking ring |
| 159 | Flange bolt |
| 161 | Hexagonal nut |
| 181 | Stepping plate |
| 182 | Support flange, front |
| 183 | Support flange, rear |
| 184 | Stepping plate support structure, front |
| 185 | Slide sleeve |
| 186 | Pivot bolt |
| 187 | Top side |
| 188 | Rubber mat |
| 190 | Elastically deformable element |
| 201 | Composite body |
| 202 | Elastomer body |
| 203 | Metal plate |
| 204 | Metal plate |
| 205 | Threaded bore |
| 206 | Threaded pin |
| 207 | Attachment screw |
| 221 | Leaf spring |
| 223 | Guide track |

What is claimed is:

1. An apparatus (10) for muscle stimulation including at least one motor (20) with two motor-operated drives (30, 130) interconnected by a drive shaft (41) each of the motor-operated drives (30, 130) comprising a frame structure (31, 131) and two separate stepping plate elements (81, 181) supported in the frame structure (31, 131) by pivot bearing structures (38, 138) arranged at one end of the stepping plate elements (81, 181) and by elastically deformable elements (90, 190) supporting the stepping plate elements at their ends opposite the pivot bearing structures (38, 138) on support flanges (82, 182), each of the motor-operated drives (30, 130) forming a quadrilateral linkage with a rotatable link formed by en eccentric ring (71) defining a crank (32, 132) of the drive shaft (41) supported on the frame structure (31, 131) in each of the motor-operated drives (30, 130), one of the cranks (32, 132) being connected pivotally to an end of one of the stepping plate elements (81, 181) opposite the respective pivot bearing structure (38, 138) and the other crank (132, 32) being pivotally joined to the other stepping plate element (81, 181) at the other end of the respective pivot bearing structure by coupling members (33, 133) and the stepping plate elements (81, 181) further being spaced from each other by a spacing of less than 2 mm.

2. The apparatus (10) according to claim 1, wherein the length of each crank (32, 132) is adjustable.

3. The apparatus (10) according to claim 1, wherein the phase angle position of the two cranks relative to each other is adjustable.

4. The apparatus (10) according to claim 1, wherein the speed of each of the two motor operated drives (30, 130) is adjustable.

5. The apparatus (10) according to claim 1, wherein the stiffness of the elastically deformable element (90,190) is adjustable.

6. The apparatus (10) according to claim 1, wherein at least one pivot joint (37, 38, 137, 138) of stepping plate elements (81, 181) includes a sensor reacting to deformations.

* * * * *